United States Patent [19]

Rykaczewski

[11] Patent Number: 4,633,563

[45] Date of Patent: Jan. 6, 1987

[54] SLIVER RETRIEVER

[76] Inventor: Stanley Rykaczewski, 5936 W. Eastwood Ave., Chicago, Ill. 60630

[21] Appl. No.: 793,216

[22] Filed: Oct. 31, 1985

[51] Int. Cl.[4] ..... B25B 27/00

[52] U.S. Cl. ..... 29/270; 294/65.5

[58] Field of Search ..... 294/65.5; 269/8, 276; 29/270, 278; 81/3 R

[56] References Cited

U.S. PATENT DOCUMENTS

| | | | |
|---|---|---|---|
| 2,606,470 | 8/1952 | Kinney | 269/276 |
| 2,947,563 | 8/1960 | Stitt | 294/65.5 |
| 3,646,492 | 2/1972 | Westermann | 294/65.5 |

*Primary Examiner*—Robert C. Watson

*Attorney, Agent, or Firm*—John J. Kowalik

[57] ABSTRACT

A tool for removing ferrous particles from a can opened by a can opener wherein the tool has an elongated handle and a magnetic assembly at one end and the magnetic assembly comprises an annular magnet positioned below a flexible plastic disc which has a peripheral undercut providing a lip which is adapted to seat upon the upper edge of the bead of the can to limit the depth of insertion of the tool into the can, the lip terminating at its inner radial edge in a shoulder which provides an annular rolling surface for the assembly for rotating it in the contaminated area attendant to the tool being moved along the inner side of the bead. The invention in one embodiment discloses a muddler in the form of corrugations formed on the bottom of a plastic cover which encases the magnet for stirring the food product to loosen the particles from the heavy viscous fluid constituting the product.

14 Claims, 6 Drawing Figures

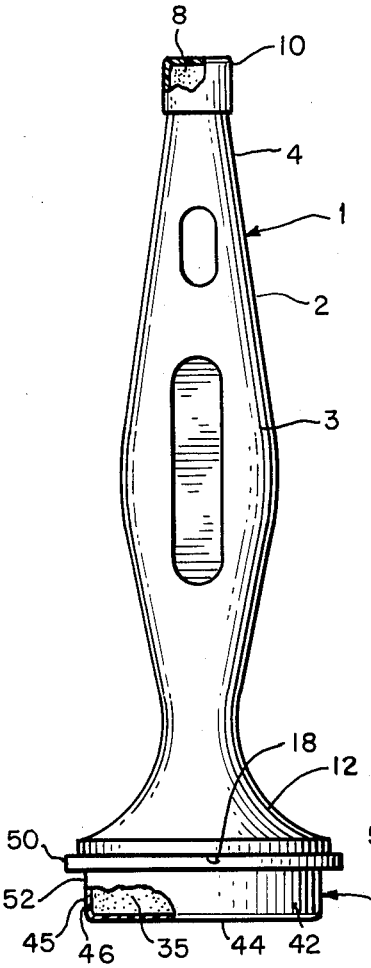
FIG. 1
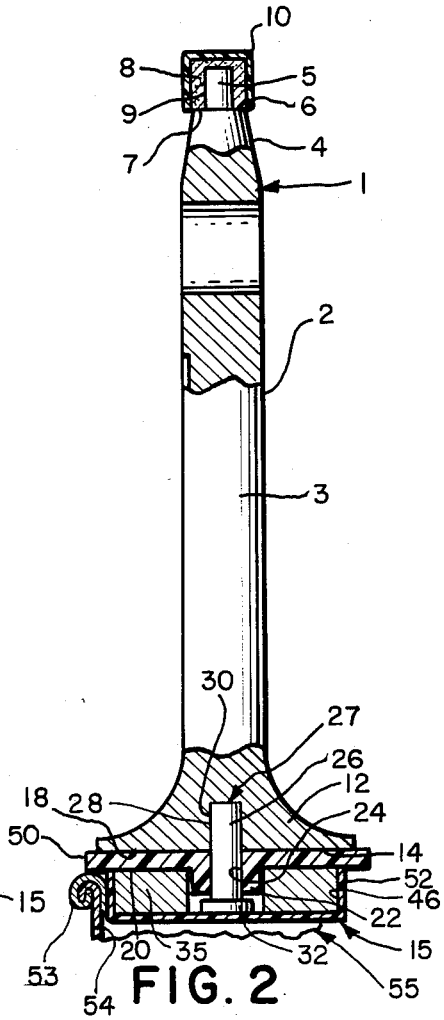
FIG. 2
FIG. 3
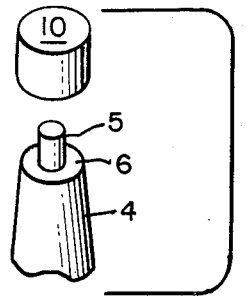
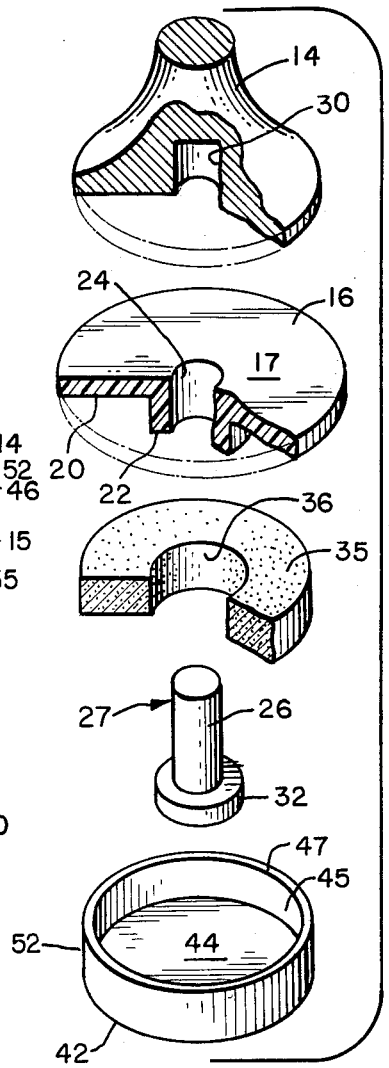
FIG. 4
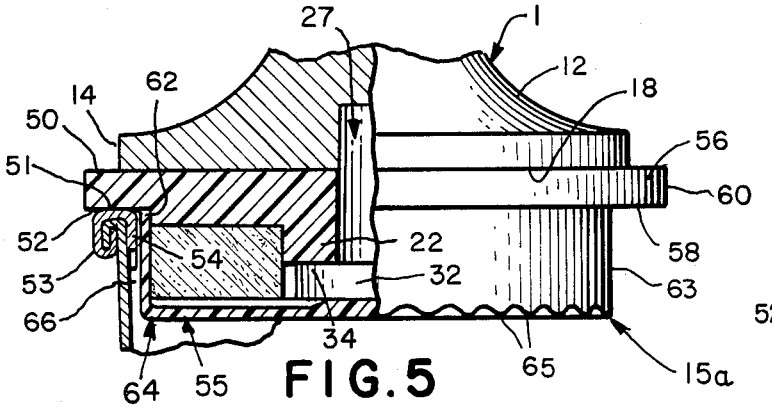
FIG. 5
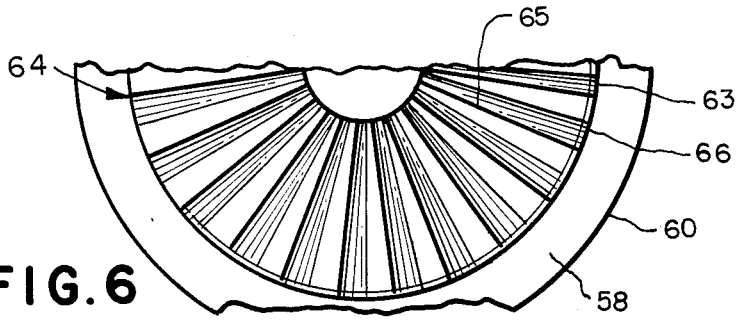
FIG. 6

SLIVER RETRIEVER

BACKGROUND OF THE INVENTION

This invention relates to devices for removing steel slivers which are shaved from the top end of a can and drop into the food during cutting an opening in the can end with a conventional can opener.

Various sliver removing devices are known. These devices generally comprise a magnet at one end of a handle. The magnet is adapted to be moved about by the handle in proximity of the open edge of the can over the food product in an attempt to attract the steel particles to the magnet. The operation of such devices or tools requires the user to be quite adept to skim over the top of the food product in the can without inserting the magnet into the food or barely touching the product so as not to muddle the steel particles into the food and thus the particles become irretrievable.

SUMMARY OF THE INVENTION

Since the steel particles fall gravitationally directly below the cut adjacent to the rim of the can, the invention is directed to a novel retriever which is guided by the rim of the can as to proximity and depth of insertion into the can.

A primary object of the invention is to provide a novel sliver remover which comprises an annular magnetic pick-up end having a guide which cooperates with the rim of the opened can, thus locating the pick-up end in proximity with the sliver-laden area and controling the depth of insertion of the remover so that the pick up end will not penetrate too deeply into the food product or will skim over the top.

A further object is to provide a guide which is flexible so that the tool may be tilted with reference to the can and have one side adjacent to the rim of the can extend deeper into the can than its diametrically opposite side which is toward the center of the can so that as the tool is rotated about the rim the particles on the magnetic pick up are lifted out of the food product and at each half revolution the tool may be withdrawn and wiped clean.

A further object is to provide a sliver remover which has rolling contact with the rim of the can while the magnetic pick-up end is positioned within the top of the open end of the can proximate the steel particle contaminant so that as the magnetic pick-up end is moved along the rim it rotates and exposes different areas of the magnet along its perimeter to the contaminant.

Another object is to provide a novel device in which the magnet is completely encased in a protective plastic cover so that the parts do not have to be disassembled for cleaning but the entire assembly can be merely rinsed thus also easily dislodging the metal particles.

A still further object is to provide a novel magnetic sliver remover comprising a rotatable structure in which the magnet is caused to ride on the rim of the open can by the user moving the tool along the rim.

The invention contemplates providing a novel magnetic sliver remover having an elongated handle with a rotatable magnet at one end encased in a plastic holder which comprises a shoulder guide adapted to engage the upper edge of the bead or rim of the can while the periphery of the annular magnet with its cover rolls along the inner edge of the bead so that the base of the magnet sweeps over the proximate area to pick up any steel slivers.

The invention also comprehends in one embodiment of the invention providing a muddler which extend along the base of the tool beneath the magnet and comprises a series of corrugations on the base of the plastic cap, said corrugations adapted to stir the uppermost layer of the liquid food product into which the pick-up is inserted and to thus bring any sliver particles in close proximity to the magnet where it will be readily attracted thereto.

These and other object and advantages inherent in and encompassed by the invention will now become more readily apparent from the specification and the drawings, wherein:

FIG. 1 is a side elevational view of one embodiment of the invention with parts broken away;

FIG. 2 is an edge elevational view of the structure shown in FIG. 1 with parts shown in longitudinal section;

FIG. 3 is a perspective exploded view of the upper portion of the tool;

FIG. 4 is a perspective exploded view partly in cross-section of the lower end portion of the tool;

FIGS. 5 and 6 illustrate a further embodiment of the invention;

FIG. 5 being a side elevational view of the lower end portion of the tool partly in cross-section, and FIG. 6 being a fragmentary bottom end view.

DESCRIPTION OF FIGS. 1–4

Describing the invention in detail and having particular reference to the drawings, the retriever tool generally designated 1 comprises an elongated handle portion 2 having an intermediate widened hand grip portion 3 which tapers toward its upper end 4 and terminates in a pin 5 centered on a shoulder 6 which seats the bottom side 7 of a cylindrical magnet 8.

The magnet 8 has a center bore 9 which tightly fits onto the pin 5 or is cemented thereto by any well known adhesive. The magnet is covered by a plastic cap 10 which may be tightly fitted thereon or cemented thereto.

The bottom or lower end portion 12 of the handle is flared to provide a wide end base 14 for mounting a magnetic pick-up assembly generally designated 15; the base being annular.

The assembly 15 comprises a plastic or elastomeric flexible annular disk 16 which has an upper flat face 17 in engagement with the bottom transverse face 18 of the base 14 and may be, if desired suitably fastened thereto by any well know adhesive or may be slidable thereagainst and rotatable with reference thereto. The flat bottom side 20 of the disk has a central hub 22, which has a center bore 24 through which extends a shank 26 of the pin 27. The upper end of the shank designated 28 is press fitted into a center bore 30 in the base 14 and the lower end of the shank is provided with a head 32 which is adapted to engage with the bottom end 34 when the disk is rotatably mounted on the pin and not secured to the base.

A donut shaped magnet 35 has a center opening 36 which tightly admits the hub 22 and on its top side 37 is preferably adhesively secured to the bottom side 20 of the disk 16. The head 32 on the lower end of the shank 26 retains the assembly to the handle.

A plastic cup-like cover 42 is provided having a flat bottom 44 and an annular skirt 45 which is pressed onto the periphery 46 of the magnet. The upper edge 47 is secured with an adhesive to the underside 38 of the disk to make the assembly watertight and prevent debris from entering into the cup and other parts of the mechanism.

In use the person grasps the handle and locates the tool with the lip portion 50 of the disk on the top edge 51 of the bead or rim 53 of an opened can 55 and the outer annular periphery 52 of the skirt is pressed against the inner side 54 of the bead. The user moves the tool around the rim which causes the magnetic assembly to rotatate above or within the top layer of the food product within the can. If the magnetic assembly is affixed to the handle, the handle is rotated as the skirt rolls along the inner side of the rim. As the magnetic assembly rotates it picks out the magnetic sliver particles. Periodically the user withdraws the tool from the can and wipes the magnetic assembly clean, thus stripping the sliver particles off the magnet, or more precisely off the plastic envelope. The user then reinserts the tool end into the can as heretofore stated and proceeds around the can until it is entirely encircled.

A feature of the invention is that the top disk is flexible. If the user finds that there is an excess of slivers in the pick-up area he may cant the tool so that the magnetic assembly dips into the food on one side of its axis and is tilted upwardly on the opposite side of its axis out of the food. As the down portion is withdrawn the user wipes it clean. Thus at each half revolution the immersed portion becomes the withdrawn portion and vice versa. Also in the event that water is lacking to rinse the tool it may be cleaned by tapping the tool against a solid object along the flexible edge portion of the disk to thus cast the particles off without demagnatizing the magnet.

DESCRIPTION OF THE EMBODIMENT OF FIGS. 5 and 6

In this embodiment parts which are essentially the same as those described in FIGS. 1–4, will be identified primarily with the same reference numerals.

The flared lower end portion 12 has its base 14 slidably opposing the top disk 56. The top disk has a peripheral undercut 58, and being made of flexible plastic or elastomeric material, is axially deflectible as a lip designated 60 circumscribing an annular axially extending shoulder 62 over which the upper end portion of a skirt 63 of a sanitary plastic cap 64 is tightly fitted, although the skirt may be adhesively secured to the shoulder. The doughnut-shaped magnet 35 fits tightly into the skirt 63 and about the hub 22 which is rotatably secured by the pin 27 to the base as in the previous embodiment.

The bottom of the cover or shield 64 is formed with a muddler in the form of a series of radial corrugations 65 such that as the magnetic assembly **15*a* rotates by riding on the periphery 66 of the skirt portion 63 against the inner side of the body of the open can while the underside of the lip 60 bears against the top edge of the rim 52 as at 51**, the muddler sweeps through the contaminated area. As the tool is moved along the bead, the magnetic assembly rotates and the muddler stirs the product in which it is immersed enhancing its search for foreign magnetic particles.

If desired, this embodiment of the invention can be canted to ride at an oblique angle to the top of the can and thus would cause immersion of only part of the magnetic assembly as described with the previous embodiment.

Having described my novel invention in its best mode, it will be realized that various other modifications will now become readily apparent to those skilled in the art which are intended to be covered in the appended claims.

I claim:

1. A tool for removing ferrous particles from a food product within an opened ferrous can having a body and a peripheral upper bead with a top edge and an inner side circumscribing a top end of a can and wherein the can is opened by shearing its top end adjacent to said inner side of the bead, said tool comprising an elongated handle, a magnetic assembly mounted on one end of the handle, said assembly comprising an annular disk having an outer edge portion adapted to seat upon the top of the bead to control the depth of insertion of the tool into the can, said assembly also comprising an annular element having a peripheral side portion offset radially inwardly of said outer edge portion of the disk and adapted to be engaged with said inner side of the bead and rolled thereagainst while the tool is bodily moved along the bead for rotating said magnetic assembly within and over the product in the vicinity of any particles for attracting them thereto, and said assembly being fastened to said handle and including a magnet and a protective cover enclosing the magnet, and said assembly being rotatable with respect to the handle, and the cover being plastic and being secured to the disk, and means providing a muddler associated with said cover.

2. The invention according to claim 1 and said muddler comprising a series of paddle like elements protruding from said cover.

3. The invention according to claim 2 and said elements comprising a series of radial corrugations on said cover projecting from the axis of rotation of said assembly to the periphery of the cover.

4. The invention according to claim 1 and said element comprising a flexible top disk of medium durameter and having a top side abutting an adjacent end of the handle and having an edge portion protruding beyond the periphery of the handle.

5. The invention according to claim 4 and said disk being slidable against said end of the handle attendant to rotation of the assembly.

6. A tool for removing ferrous slivers from food in a can having a top panel with a circumscribing bead and wherein the panel is severed from the bead, said tool having a handle, a magnetic assembly rotatably carried by the handle, said assembly comprising bead-engaging first means for guiding said tool along the bead within the can and having a second bead-engaging means for limiting the depth of inserion of the tool into the can, and said magnetic assembly comprising an annular flexible disk having a bottom side with an annular peripheral groove thereabout, and said said second means comprising a bottom face in the groove for engaging the top of the bead, and said first mentioned means comprising a face of the groove for opposing and engaging in rolling contact with the side of the bead.

7. The invention according to claim 6 and a protective cover having an annular skirt portion partially sleeved over said face of said first means, a magnet within said cover having a center opening, said disk having a hub tightly fitted within the opening, and a pin extending through said opening and hub into said handle for securing the same to each other.

8. The invention according to claim 7 and said cover having a bottom integral with the bottom edge of said skirt, and said skirt having an upper edge adhesively secured to the bottom side of the disk.

9. The invention according to claim 7 and said cover comprising muddler means stirring food product into which the tool is immersed.

10. The invention according to claim 9 and the muddler means comprising a series of corrugations on the bottom of said skirt.

11. A tool for stirring and removing slivers of magnetically attractable metal particles from a sheared open end of a can having an upper edge portion with a bead thereabout, said tool having a handle with an end, a magnetic assembly on said end comprising a top disk with peripheral guide means adapted to engage the bead for limiting depth of insertion of the tool into the can and for guiding the tool within the can for travel along the interior of the bead, and said disk being flesible and deflectible against said bead for positioning of the tool at selected attitudes with respect thereto.

12. The invention according to claim 11 and said assembly having an annular magnet and said disk having a hub extending through said magnet.

13. The invention according to claim 12 and said disk being made of flexible resin and, means supporting said assembly for rotation with respect to said handle.

14. The invention according to claim 13 and said magnet being encased in a plastic envelope.

* * * * *